US011655776B1

(12) United States Patent
Petrus et al.

(10) Patent No.: US 11,655,776 B1
(45) Date of Patent: May 23, 2023

(54) CYLINDER BLOCK CASTING SLAB CORE CAST GEOMETRY FOR SAWCUT ENTRANCE ENHANCEMENT

(71) Applicant: GM Global Technology Operations LLC, Detroit, MI (US)

(72) Inventors: Ronald John Petrus, Lake Orion, MI (US); Richard M. Nichols, III, Macomb, MI (US); Brian C. Leuenhagen, Clarkston, MI (US); William A. Berry, Davison, MI (US); Qigui Wang, Rochester Hills, MI (US); James T. Singer, Defiance, OH (US)

(73) Assignee: GM GLOBAL TECHNOLOGY OPERATIONS LLC, Detroit, MI (US)

( * ) Notice: Subject to any disclaimer, the term of this patent is extended or adjusted under 35 U.S.C. 154(b) by 0 days.

(21) Appl. No.: 17/704,535

(22) Filed: Mar. 25, 2022

(51) Int. Cl.
*F02F 1/16* (2006.01)
*B22C 9/10* (2006.01)

(52) U.S. Cl.
CPC ..... *F02F 1/16* (2013.01); *B22C 9/10* (2013.01); *F02F 2200/06* (2013.01)

(58) Field of Classification Search
CPC ..... F02F 2200/06; F02F 1/16; B22C 9/10
See application file for complete search history.

(56) References Cited

U.S. PATENT DOCUMENTS 5,333,668 A * 8/1994 Jorstad ..... B22D 19/08 164/102
5,372,176 A * 12/1994 Brown ..... F02F 1/4271 164/249
2017/0037810 A1* 2/2017 Beyer ..... F02F 11/002
2020/0362793 A1* 11/2020 Choudhary ..... B22D 19/00

* cited by examiner

*Primary Examiner* — Kevin A Lathers
(74) *Attorney, Agent, or Firm* — Vivacqua Crane PLLC

(57) ABSTRACT

An automobile vehicle engine includes multiple water jackets individually formed in a cast engine block proximate to successive ones of multiple cylinder bores. Multiple cast-in place transition regions are individually formed during a casting operation of the cast engine block at entrances to individual ones of the multiple water jackets. Individual ones of multiple sawcuts open into individual ones of the multiple cast-in place transition regions.

16 Claims, 7 Drawing Sheets

CYLINDER BLOCK CASTING SLAB CORE CAST GEOMETRY FOR SAWCUT ENTRANCE ENHANCEMENT

GOVERNMENT LICENSE RIGHTS

This invention was made with government support under United States Department of Energy (USDOE) contract: DE-EE0008877 awarded by the United States Department of Energy. The government has certain rights to the invention.

INTRODUCTION

The present disclosure relates to automobile vehicle engine cylinder blocks having water-jacket cooling channels.

In automobile vehicle engine blocks a sawcut is machined into a cylinder head area proximate to coolant entry ramps to enhance coolant flow to cylinder walls. The current process for the sawcut geometry requires the sawcut and ramps between the sawcut and the coolant entry ports to be machined in individual bore bridges. The production block will then contain sharp corners between the water-jacket casting surfaces and the sawcuts which generate high stress concentrations and lowers safety factors. In addition to difficulties in machining the sawcuts, the existing entrance ramp shapes are difficult to measure and a positional tolerance of the entrance ramps is difficult to control.

Thus, while current engine coolant sawcut designs used in automobile vehicle engine blocks achieve their intended purpose, there is a need for a new and improved engine block design having improved coolant flow designs.

SUMMARY

According to several aspects, an automobile vehicle engine includes multiple water jackets individually formed in a cast engine block proximate to successive ones of multiple cylinder bores. Multiple cast-in place transition regions are individually formed during a casting operation of the cast engine block at entrances to individual ones of the multiple water jackets. Individual ones of multiple sawcuts open into individual ones of the multiple cast-in place transition regions.

In another aspect of the present disclosure, a curved region of the cast-in place transition regions opens into one of the multiple water jackets, the curved region formed during casting at a junction of individual ones of the multiple water jackets and individual ones of the cast-in place transition regions.

In another aspect of the present disclosure, individual ones of multiple sawcuts extend into the curved region.

In another aspect of the present disclosure, the multiple cast-in place transition regions define a semi-circular shaped slot extending through the curved region.

In another aspect of the present disclosure, the multiple cast-in place transition regions include: a first downwardly tapering slot which transitions at a first interface into a second downwardly tapering slot; a surface slot interface between an open end of one of the multiple sawcuts and the second downwardly tapering slot; and the second downwardly tapering slot transitions via a second interface into a curved region which opens into the water jacket.

In another aspect of the present disclosure, the multiple cast-in place transition regions individually include a tapering portion which opens into a continuous width portion.

In another aspect of the present disclosure, the multiple sawcuts have a first continuous width for a length of the multiple sawcuts.

In another aspect of the present disclosure, the continuous width portion defines a semi-circular or a concave shape throughout a length of the continuous width portion and has a second continuous width which is greater than the first continuous width.

In another aspect of the present disclosure, the cast-in place transition regions and the corner radius are collectively formed by a sand slab core during casting.

In another aspect of the present disclosure, the cast-in place transition regions, the corner radius and the semi-circular shaped slot are collectively shaped by a sand slab core during casting.

According to several aspects, an automobile vehicle engine block includes multiple water jackets individually formed in a cast engine block proximate to individual cylinder bores. Multiple cast-in-place transition regions are individually formed during a casting operation forming the cast engine block located proximate to individual ones of the multiple water jackets. A curved region of individual ones of the cast-in-place transition regions opens into one of the multiple water jackets. The cast-in-place transition regions including the curved region are collectively formed as a sand slab core during casting.

In another aspect of the present disclosure, multiple sawcuts are created in individual bore bridges positioned between successive ones of the cylinder bores.

In another aspect of the present disclosure, individual ones of the multiple sawcuts open into individual ones of the multiple cast-in-place transition regions.

In another aspect of the present disclosure, the multiple cast-in-place transition regions have a first end proximate to the curved region and a second end opening into one of the multiple sawcuts, the second end narrower than the first end.

In another aspect of the present disclosure, individual ones of the multiple cast-in-place transition regions include: a first semi-circular portion having a first transition zone changing into a second semi-circular portion; and a surface slot interface positioned between an open end of individual ones of the multiple sawcuts and the second semi-circular portion.

In another aspect of the present disclosure, the curved region has a concave shape.

In another aspect of the present disclosure, a second transition zone transitions from the second semi-circular portion into a downwardly sloping third semi-circular portion which opens into the water jacket.

According to several aspects, a method for preparing an automobile vehicle engine block comprises: forming multiple water jackets proximate to individual cylinder bores; individually positioning multiple cast-in place transition regions at entrances to individual ones of the multiple water jackets; and creating a curved region of individual ones of the cast-in-place transition regions which opens into one of the multiple water jackets.

In another aspect of the present disclosure, the method further includes: collectively forming the cast-in-place transition regions including the curved region as a sand slab core during casting; and forming a core insert for insertion into the slab sand core.

In another aspect of the present disclosure, the method further includes forming the core insert having an inorganic sand core insert.

Further areas of applicability will become apparent from the description provided herein. It should be understood that the description and specific examples are intended for purposes of illustration only and are not intended to limit the scope of the present disclosure.

BRIEF DESCRIPTION OF THE DRAWINGS

The drawings described herein are for illustration purposes only and are not intended to limit the scope of the present disclosure in any way.

DETAILED DESCRIPTION

The following description is merely exemplary in nature and is not intended to limit the present disclosure, application, or uses.

Figure 1:
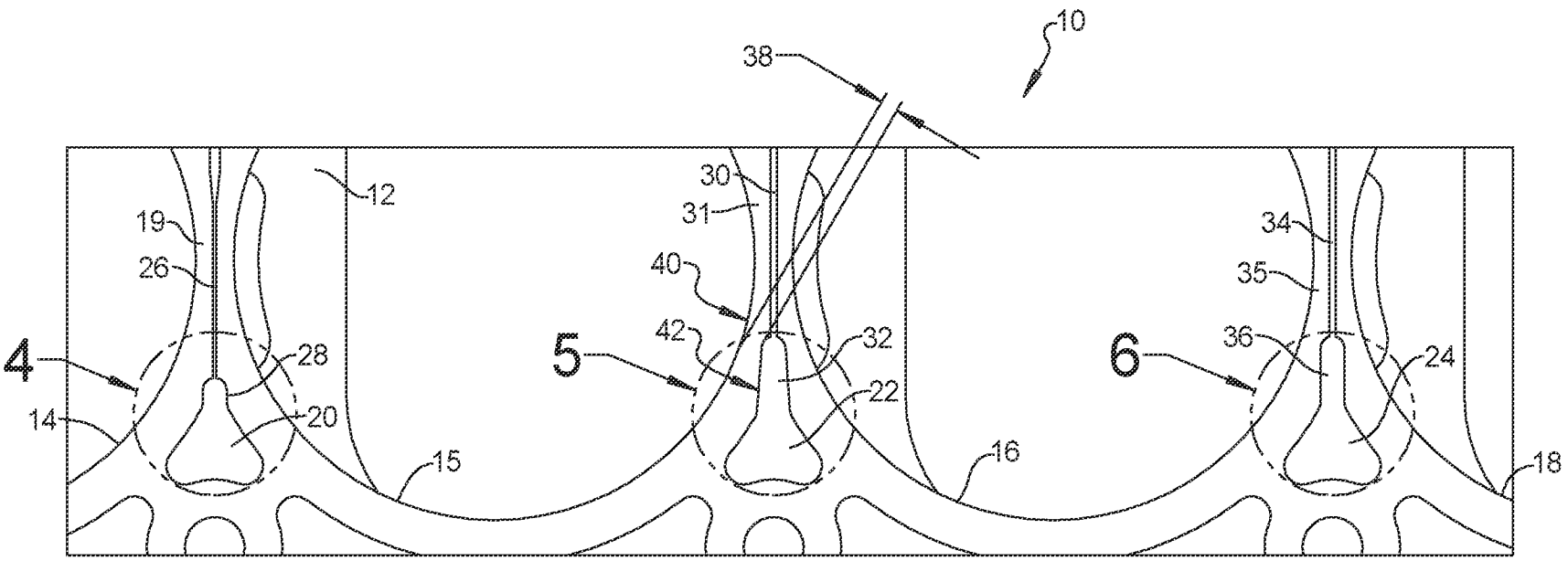
FIG. 1 is a top plan view of a cylinder block casting slab core cast geometry with surface slot entrance according to an exemplary aspect.

Referring to FIG. 1, a cylinder block casting slab core cast geometry with surface slot entrance 10 includes an engine cylinder block casting 12 for an engine of an automobile vehicle having exemplary multiple cylinder bores including an first cylinder bore 14, a second cylinder bore 15, a third cylinder bore 16 and a fourth cylinder bore 18. Successive pairs of the cylinder bores are separated by a bore bridge such as an exemplary first bore bridge 19. A quantity of the cylinder bores is not determinative and can vary from two up to twelve cylinder bores within the scope of the present disclosure. A coolant is supplied between successive ones of the cylinder bores into individual ones of multiple water jackets formed during casting in the bore bridges, including: a first water jacket 20 created between the first cylinder bore 14 and the second cylinder bore 15; a second water jacket 22 created between the second cylinder bore 15 and the third cylinder bore 16; and a third water jacket 24 created between the third cylinder bore 16 and the fourth cylinder bore 18.

To promote effective cooling flow from the water jackets, a sawcut is machined into individual ones of the bore bridges after the casting operation is completed such as for example a first sawcut 26 machined into the first bore bridge 19. Known sawcuts create coolant passages which include sharp corners and edges at entrance ramps between the sawcut and the water jacket. Known sawcut geometry inhibits coolant flow, therefore according to several aspects transition regions are formed during the casting operation between the location where sawcuts will be machined into bore bridges and individual ones of the water jackets. The transition regions provide a streamlined flow path where individual ones of the sawcuts open into individual ones of the water jackets. According to several aspects, the transition regions may vary in geometry thereby providing multiple optional transition region designs to enhance coolant flow.

Figure 4:
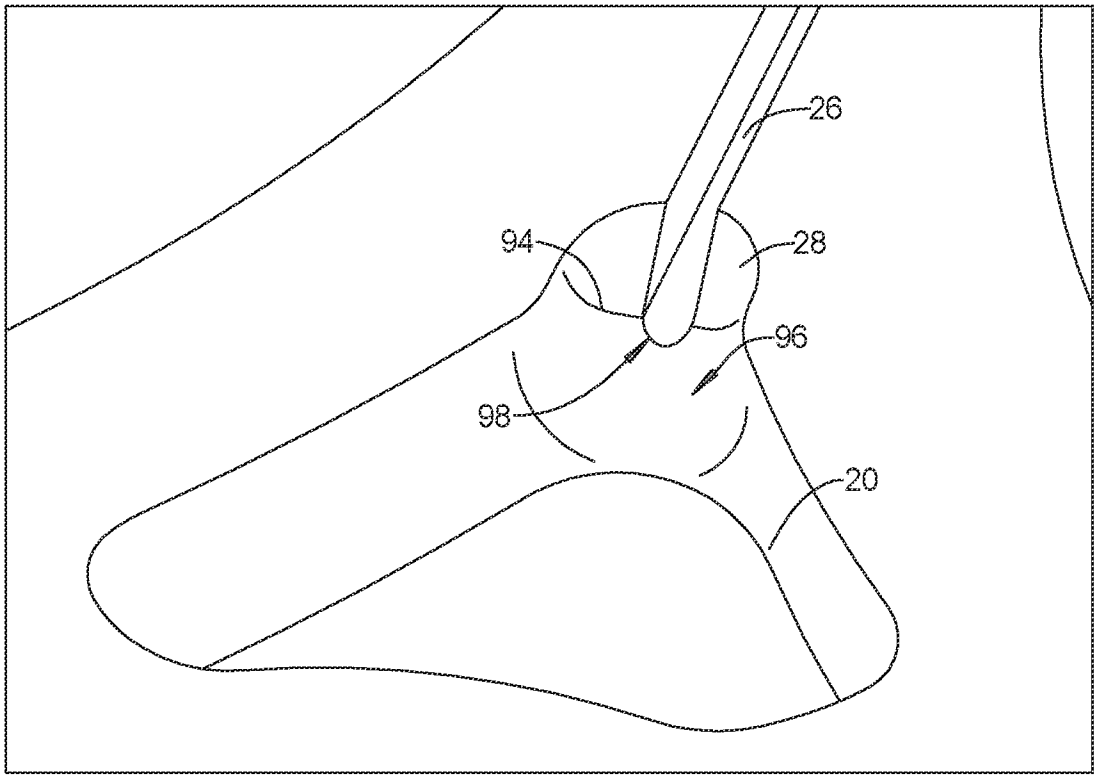
FIG. 4 is a top perspective view of area 4 of FIG. 1.
Figure 5:
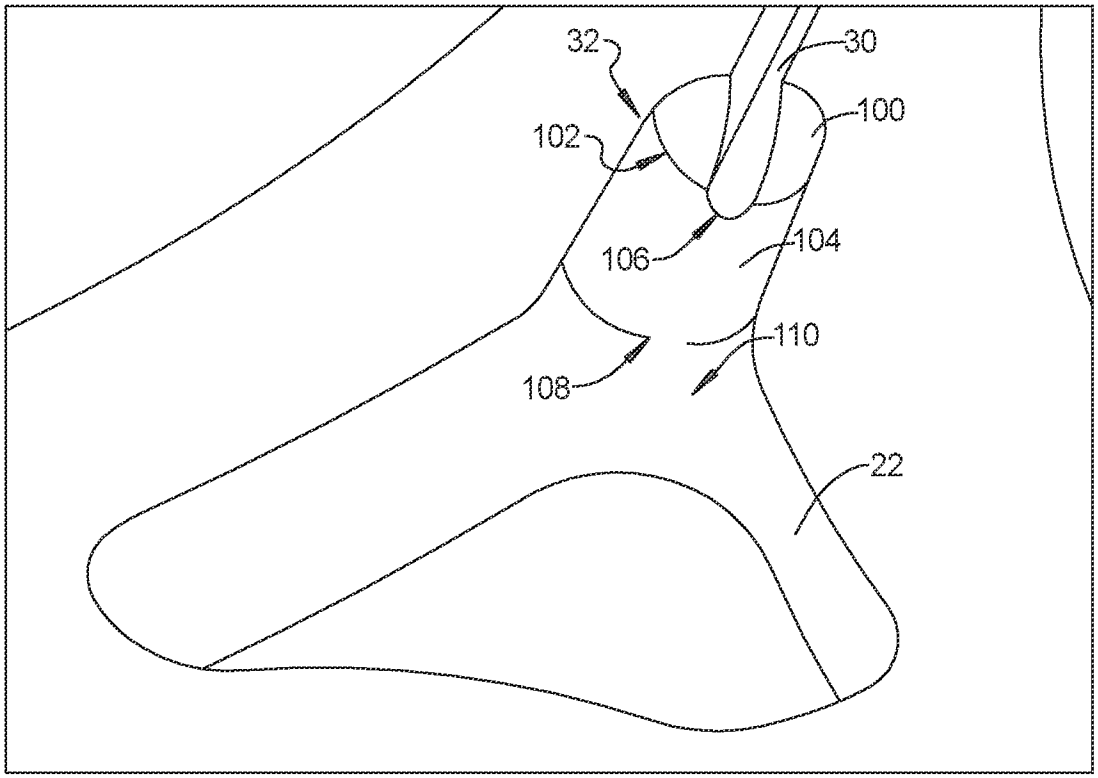
FIG. 5 is a top perspective view of area 5 of FIG. 1.
Figure 6:
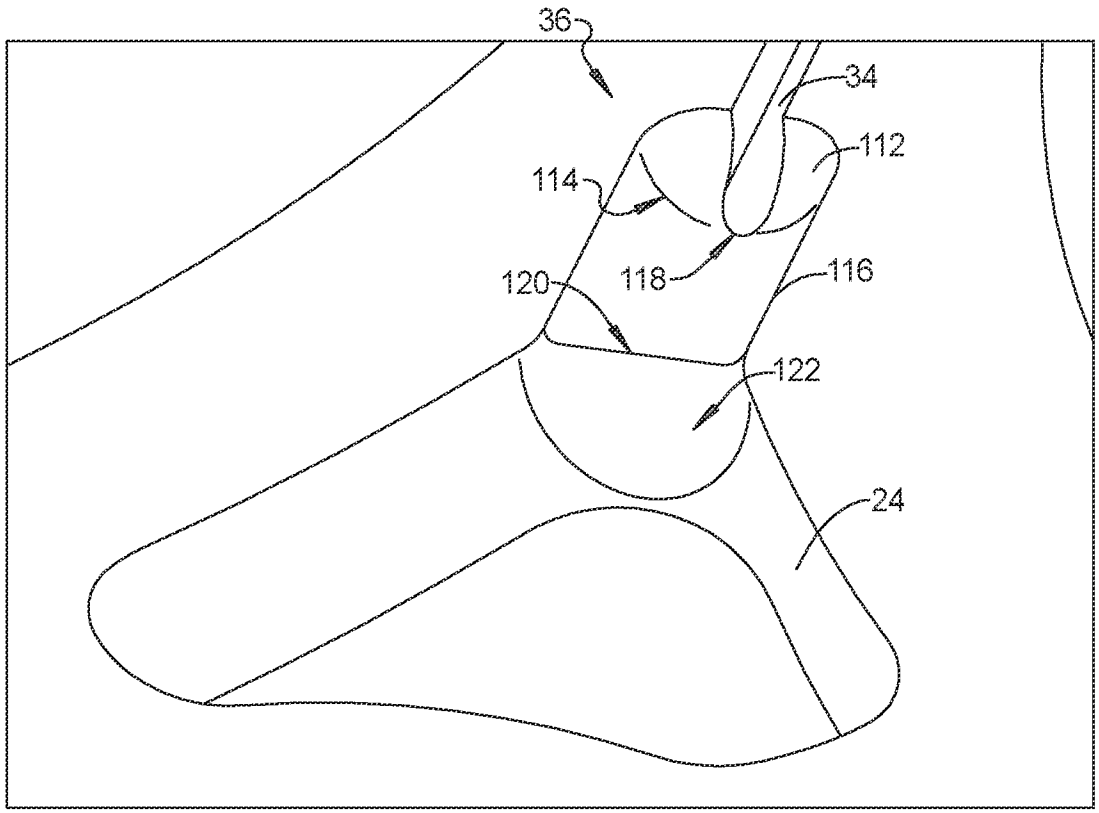
FIG. 6 is a top perspective view of area 6 of FIG. 1.

According to several aspects, a first transition region 28 is created during casting at the first water jacket 20 and an entrance location of the first sawcut 26 when the first sawcut 26 is subsequently machined. The first transition region 28 is shown and described in greater detail in reference to FIG. 4. A second sawcut 30 is machined after casting in a second bore bridge 31 separating the second cylinder bore 15 and the third cylinder bore 16. A second transition region 32 is created during casting at the second water jacket 22 and an entrance location of the second sawcut 30 when the second sawcut 30 is subsequently machined. The second transition region 32 is shown and described in greater detail in reference to FIG. 5. Similarly, a third sawcut 34 is machined after casting in a third bore bridge 35 separating the third cylinder bore 16 and the fourth cylinder bore 18. A third sawcut 34 is machined after casting in a bore bridge separating the third cylinder bore 16 and the fourth cylinder bore 18. A third transition region 36 is created during casting at the third water jacket 24 and an entrance location of the third sawcut 34 when the third sawcut 34 is subsequently machined. The third transition region 36 is shown and described in greater detail in reference to FIG. 6.

According to several aspects, a minimum clearance 38 of 4.5 mm is maintained between a cylinder bore wall 40 of any of the cylinder bores and a closest point-of-approach of the cylinder bore wall 40 to a transition region wall 42 of any of the transition regions. The minimum clearance 38 is maintained to retain an operational strength and rigidity of the engine cylinder block casting 12 where cast material is omitted to create the transition regions.

Referring to FIG. 2 and again to FIG. 1, according to several aspects, a cylinder block casting slab core cast geometry with surface slot entrance 44 differs from the cylinder block casting slab core cast geometry with surface slot entrance 10 as follows. A sawcut 46 having a first continuous width 47 over its length is machined into a machined deck face 48 of a fourth bore bridge 50 which separates an exemplary cylinder bore 52 and a next successive cylinder bore 54. The sawcut 46 at an interface 56 opens into a transition region 58 having a tapering portion 60 which opens into a continuous width portion 62. The continuous width portion 62 defines a semi-circular or a concave shape throughout its length and has a second continuous width 64 which is greater than the first continuous width 47 of the sawcut 46. The sawcut 46 transitions from the continuous width portion 62 via a curved transition region 66 into a curving portion 68 to open into a water jacket 70. An interface junction 72 between the continuous width portion 62 and the curving portion 68 is rounded to further reduce coolant flow drag and flow resistance.

Figure 3:
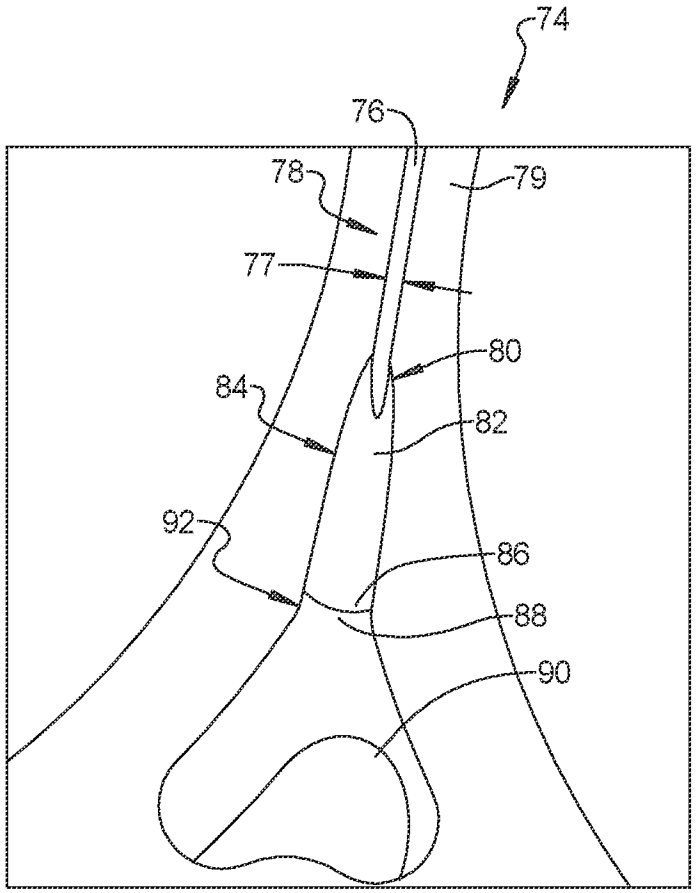
FIG. 3 is a top perspective view modified from FIG. 1.
Figure 2:
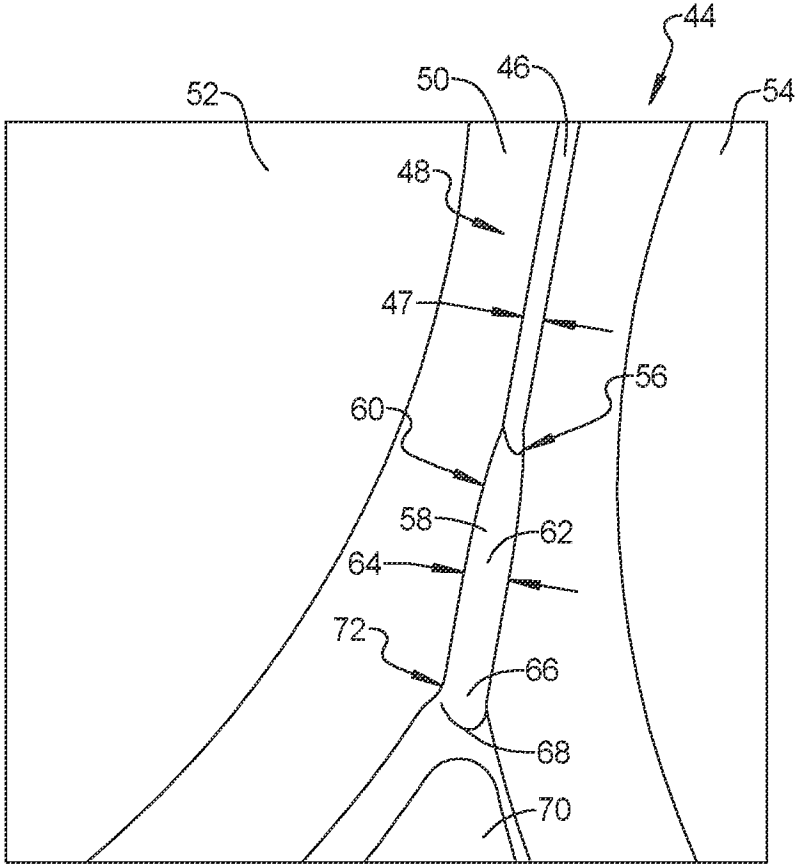
FIG. 2 is a top perspective view modified from FIG. 1.

Referring to FIG. 3 and again to FIGS. 1 and 2, according to several aspects, a cylinder block casting slab core cast geometry with surface slot entrance 74 differs from the cylinder block casting slab core cast geometry with surface slot entrance 10 and the cylinder block casting slab core cast geometry with surface slot entrance 44 as follows. A sawcut 76 having a first continuous width 77 over its length is machined into a machined deck face 78 of a fifth bore bridge 79 which separates successive cylinder bores. The sawcut 76 at a rounded interface 80 opens into a transition region 82 defining a continuously tapering portion 84 which continuously increases in width between the rounded interface 80 and a curved transition region 86. The curved transition region 86 transitions into a curving portion 88 which opens into a water jacket 90. The continuously tapering portion 84 defines a semi-circular or a concave shape throughout its length. An interface junction 92 between the transition region 82 and the curved transition region 86 is rounded to further reduce coolant flow drag and flow resistance.

Referring to FIG. 4 and again to FIG. 1, the first transition region 28 may include a downwardly sloping portion 94 which transitions into a curved region 96 which opens into the first water jacket 20. A surface slot interface 98 between an open end of the first sawcut 26 and the curved region 96 reduces turbulence for coolant flowing into the first sawcut 26.

Referring to FIG. 5 and again to FIG. 1, the second transition region 32 may include a first downwardly tapering slot 100 which transitions at a first interface 102 into a second downwardly tapering slot 104. A surface slot interface 106 between an open end of the second sawcut 30 and the second downwardly tapering slot 104 reduces turbulence for coolant flowing into the second sawcut 30. The second downwardly tapering slot 104 transitions via a second interface 108 into a curved region 110 which opens into the second water jacket 22.

Referring to FIG. 6 and again to FIG. 1, the third transition region 36 differs from the first transition region 28 by the use of semi-circular flow passages. The third transition region 36 may include a first semi-circular portion 112 which at a first transition zone 114 changes into a second semi-circular portion 116. A surface slot interface 118 between an open end of the third sawcut 34 and the second semi-circular portion 116 reduces turbulence for coolant flowing into the third sawcut 34. From the second semi-circular portion 116 a second transition zone 120 transitions into a downwardly sloping third semi-circular portion 122 which opens into the third water jacket 24.

Referring to FIG. 7 and again to FIG. 1, a slab core 124 as-cast geometry provides an approximately 10 mm depth of a water jacket 126. An approximate 4.75 mm split line 128 below a machined deck face 130 eliminates a need to machine a V-shaped sawcut.

Figure 7:
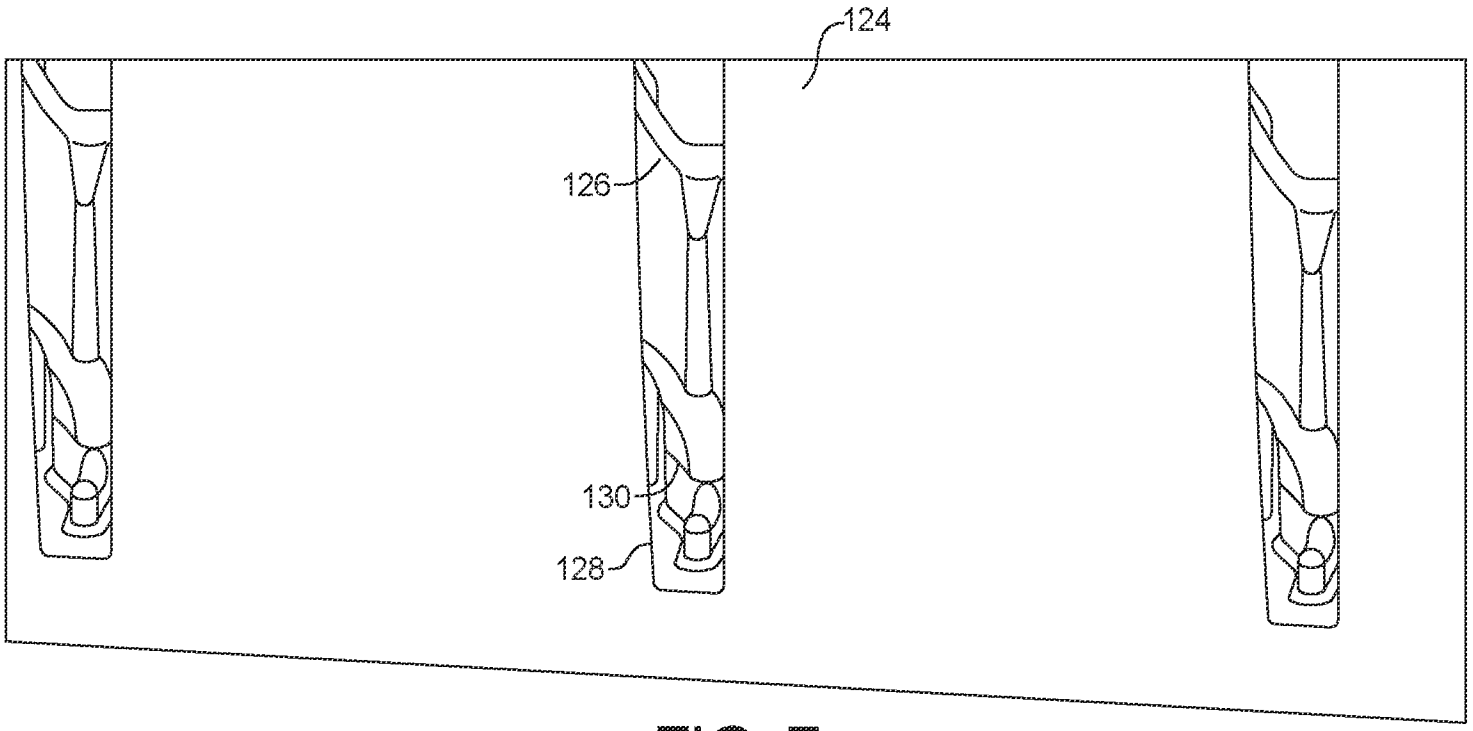
FIG. 7 is a cross sectional side elevational view of a slab core for casting the engine block of FIG. 1.
Figure 8:
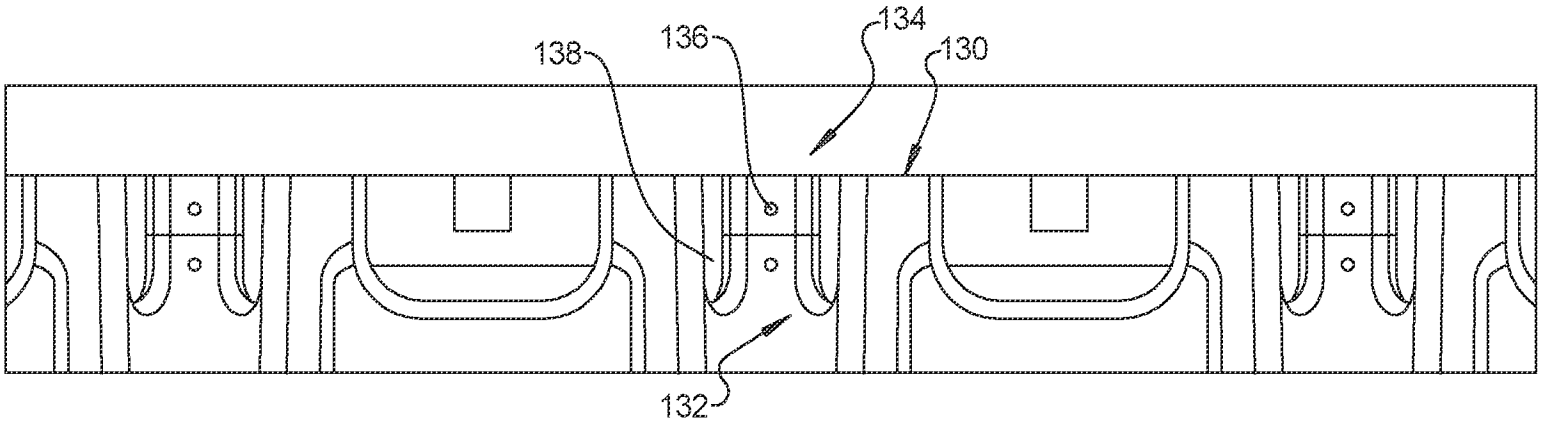
FIG. 8 is a cross sectional side elevational view of a water jacket formed at an interface with a machined deck face and a slab core as-cast for the exemplary aspect of FIG. 1.

Referring to FIG. 8 and again to FIG. 7, a water jacket 132 formed at an interface with the machined deck face 130 and a slab core 134 provides approximately 10 mm of the water jacket geometry 136 within the slab core 134 at multiple locations. A split line at approximately 4.75 mm below the machined deck face 130 is provided only at the locations of the water jacket geometry 136 to provide for the formation of transition regions 138 which may be formed as any of the transition regions discussed herein.

A cylinder block casting slab core cast geometry with surface slot entrance of the present disclosure offers several advantages. These include elimination of sharp corners between a cast water jacket and a known sawcut to create a more streamlined shape to be cast into the cylinder block. This geometry provides transition regions which eliminate machined entrance ramps for the machined sawcuts. The slot sand core may be formed using an in-organic sand core insert which is molded together with a slab sand core.

The description of the present disclosure is merely exemplary in nature and variations that do not depart from the gist of the present disclosure are intended to be within the scope of the present disclosure. Such variations are not to be regarded as a departure from the spirit and scope of the present disclosure.

What is claimed is:

1. An automobile vehicle engine, comprising:

multiple water jackets individually formed in a cast engine block proximate to successive ones of multiple cylinder bores;

multiple cast-in place transition regions individually formed during a casting operation of the cast engine block at entrances to individual ones of the multiple water jackets;

multiple sawcuts having individual ones of the multiple sawcuts opening into individual ones of the multiple cast-in place transition regions; and a curved region of the multiple cast-in place transition regions which opens into one of the multiple water jackets, the curved region formed during casting at a junction of individual ones of the multiple water jackets and individual ones of the cast-in place transition regions, wherein the multiple cast-in place transition regions define a semi-circular shaped slot extending through the curved region.

2. The automobile vehicle engine of claim 1, wherein individual ones of multiple sawcuts extend into the curved region.

3. The automobile vehicle engine of claim 1, wherein the multiple cast-in place transition regions include:

a first downwardly tapering slot which transitions at a first interface into a second downwardly tapering slot;

a surface slot interface between an open end of one of the multiple sawcuts and the second downwardly tapering slot; and the second downwardly tapering slot transitions via a second interface into a curved region which opens into one of the multiple water jackets.

4. The automobile vehicle engine of claim 1, wherein the multiple cast-in place transition regions individually include a tapering portion which opens into a continuous width portion.

5. The automobile vehicle engine of claim 4, wherein the multiple sawcuts have a first continuous width for a length of the multiple sawcuts.

6. The automobile vehicle engine block of claim 5, wherein the continuous width portion defines a semi-circular or a concave shape throughout the continuous width portion and having a second continuous width which is greater than the first continuous width.

7. The automobile vehicle engine of claim 1, wherein the cast-in place transition regions and the curved region are collectively formed by a sand slab core during casting.

8. The automobile vehicle engine of claim 1, including:

a sand slab core wherein the cast-in place transition regions are collectively shaped by the sand slab core during casting; and a core insert for insertion into a slab sand core; and wherein the core insert includes an inorganic sand core insert.

9. An automobile vehicle engine block, comprising:

multiple water jackets individually formed in a cast engine block proximate to individual ones of multiple cylinder bores;

multiple cast-in-place transition regions individually formed and located proximate to individual ones of the multiple water jackets during a casting operation forming the cast engine block;

a curved region of individual ones of the cast-in-place transition regions which opens into one of the multiple water jackets, the cast-in-place transition regions including the curved region collectively formed as a sand slab core during casting; and multiple sawcuts created in individual bore bridges positioned between successive ones of the multiple cylinder bores, wherein individual ones of the multiple cast-in-place transition regions include:

a first semi-circular portion having a first transition zone changing into a second semi-circular portion; and a surface slot interface positioned between an open end of individual ones of the multiple sawcuts and the second semi-circular portion.

10. The automobile vehicle engine block of claim 9, further including individual ones of the multiple sawcuts opening into individual ones of the multiple cast-in-place transition regions.

11. The automobile vehicle engine block of claim 10, wherein a first end of the multiple cast-in-place transition regions is positioned proximate to the curved region and a second end of the multiple cast-in-place transition regions opens into one of the multiple sawcuts, the second end narrower than the first end.

12. The automobile vehicle engine block of claim 9, wherein the curved region has a concave shape.

13. The automobile vehicle engine block of claim 12, further including a second transition zone transitioning from the second semi-circular portion into a downwardly sloping third semi-circular portion which opens into one of the multiple water jackets.

14. A method for casting an automobile vehicle engine block, comprising:

forming multiple water jackets individually formed in a cast engine block proximate to successive ones of multiple cylinder bores;

forming multiple cast-in place transition regions individually formed during a casting operation of the cast engine block at entrances to individual ones of the multiple water jackets;

forming multiple sawcuts having individual ones of the multiple sawcuts opening into individual ones of the multiple cast-in place transition regions; and forming a curved region of the multiple cast-in place transition regions which opens into one of the multiple water jackets, the curved region formed during casting at a junction of individual ones of the multiple water jackets and individual ones of the cast-in place transition regions, wherein the multiple cast-in place transition regions define a semi-circular shaped slot extending through the curved region.

15. The method of claim 14, further comprising:

collectively forming the multiple cast-in-place transition regions including the curved region as a sand slab core during casting; and forming a core insert for insertion into the slab sand core.

16. The method of claim 15, further comprising forming the core insert having an inorganic sand core insert.

* * * * *